US005857845A

United States Patent [19]

Paciorek

[11] Patent Number: 5,857,845

[45] Date of Patent: Jan. 12, 1999

[54] INDEPENDENT BURNER IGNITION AND FLAME-SENSE FUNCTIONS

[76] Inventor: Raymond M. Paciorek, 1909 72nd St., Darien, Ill. 60561

[21] Appl. No.: 835,890

[22] Filed: Apr. 8, 1997

[51] Int. Cl.[6] ..... F23N 5/00

[52] U.S. Cl. ..... 431/74; 431/71

[58] Field of Search ..... 431/71, 74, 46

[56] References Cited

U.S. PATENT DOCUMENTS

| | | | |
|---|---|---|---|
| 3,270,799 | 9/1966 | Pinckaers | 431/71 |
| 3,947,220 | 3/1976 | Dietz | 431/71 |
| 4,145,180 | 3/1979 | Bendorf | 431/71 |
| 4,230,444 | 10/1980 | Matthews | 431/71 |
| 4,231,732 | 11/1980 | Newport et al. | 431/74 |
| 4,359,315 | 11/1982 | Matthews | 431/71 |
| 4,626,193 | 12/1986 | Gann | 431/71 |
| 5,141,431 | 8/1992 | Geary | 431/71 |
| 5,348,466 | 9/1994 | Momber | 431/71 |

*Primary Examiner*—Carroll B. Dority

*Attorney, Agent, or Firm*—Terrence (Terry) Martin; Jules Jay Morris; Sean D. Detweiler

[57] ABSTRACT

An ignition/reignition circuit (10) for a gas burner (12) having separate flame sensing and ignition electrodes. The flame sensing electrode (25,30) trips a switch (Q1) upon transition from sensor output signals indicative of the sensed presence of a flame to a sensed absence. The switch is coupled to a spark generator circuit which includes a spark electrode (16) for reigniting the burner in the event of flame failure.

21 Claims, 2 Drawing Sheets

INDEPENDENT BURNER IGNITION AND FLAME-SENSE FUNCTIONS

BACKGROUND AND SUMMARY OF THE INVENTION

The present invention relates generally to gas burners and, more particularly, to an improved ignition and flame sensing circuit for maintaining the continued presence of a flame.

In various gas powered appliances such as cooking ranges, water heaters and clothes dryers, flame sensors are typically provided in order to ensure continued flame presence after ignition. In the event that a flame is lost, ignition sparks are generated to effect reignition. One example of such an ignition/reignition circuit having a flame sensing capability is provided in U.S. Pat. No. 5,169,303 to Paluck, the disclosure of which is hereby incorporated herein by reference. Paluck teaches a type of flame sensing and reignition circuit for a gas burner which uses the same ignition electrode in providing the flame sensing as well as the ignition functions of the circuit.

While this design minimizes the total number of circuit components, certain compromises must be made, especially in determining the position of the ignition electrode. An optimum position of the electrode with respect to the burner for accomplishing ignition may result in an electrode position which is most susceptible to flame waver. Placing the electrode at a radial distance from the burner body which provides a sufficient spark gap for ignition may result in an electrode positioned too far from the burner to accurately sense a very low burning flame. A less than optimal flame sensing position can result in errant determinations of flame absence which in turn causes nuisance sparking or the generation of reignition sparks in the continued presence of the flame.

The ignition and flame sensing circuit of the present invention provides an improvement over prior circuits of this type in that separate flame sensing and reignition electrodes are employed. Each flame sensing electrode is coupled to a switch which is tripped when the flame sensor no longer provides indication of a sensed flame. The switch in turn causes a spark generator to reignite the burner by producing a series of ignition sparks. Once a flame is once again sensed by the flame sensor, the sparking is stopped.

By optimizing the placement of the flame sensor based upon the conditions in which the burner will be operated, the likelihood of nuisance sparking is substantially reduced. Separate flame sensing electrodes also facilitate the provision of multiple flame sensors wired in parallel at strategic positions about the burner in order to further prevent random sparking at points of poor gas ignition or during flame waver.

These and other objects and advantages of the present invention will become apparent upon review of the following description taken in view of the accompanying drawings.

DETAILED DESCRIPTION OF THE PREFERRED EMBODIMENTS

Figure 1:
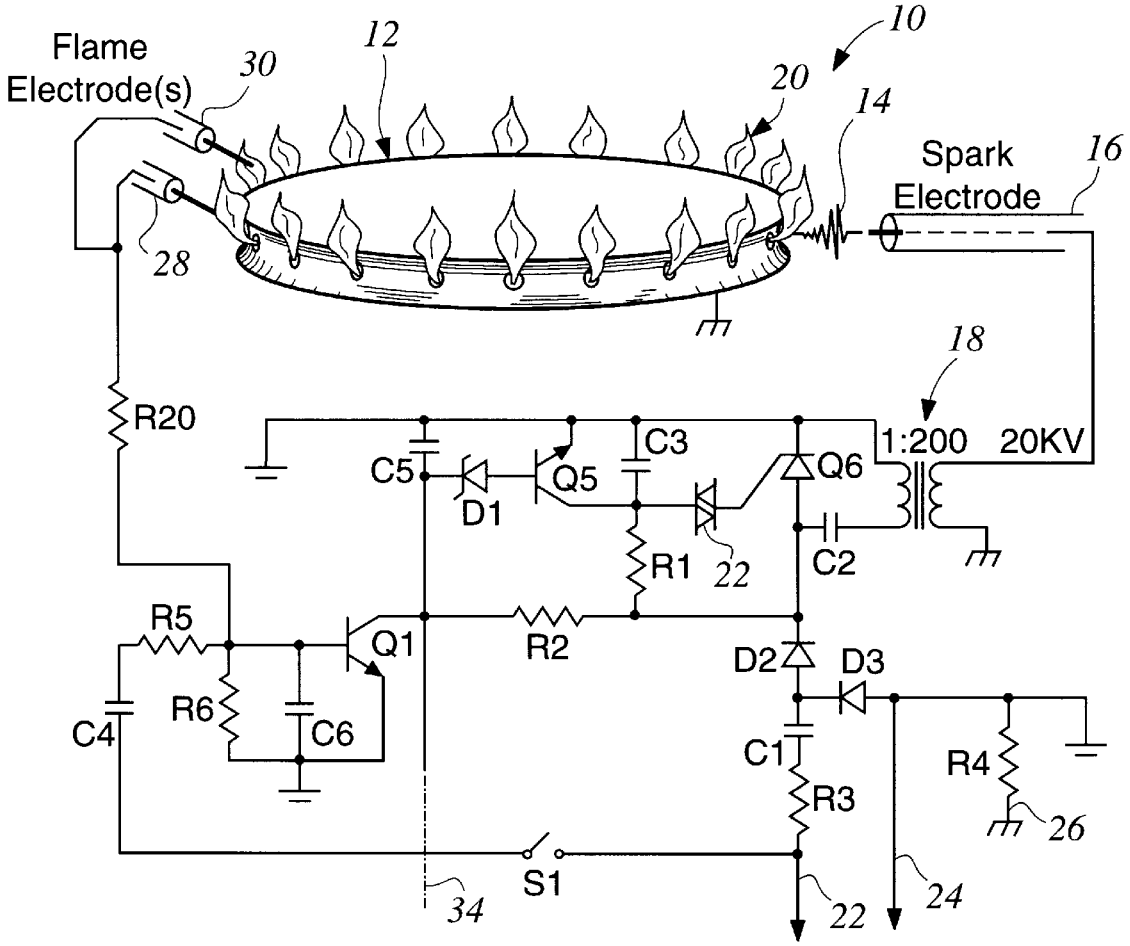
FIG. 1 is a schematic circuit diagram illustrating a preferred embodiment of the flame sensing and ignition circuit made in accordance with the teachings herein.

Turning now to the drawings, and in particular to FIG. 1, a flame sensing and ignition circuit made in accordance with the teachings of the present invention is indicated generally at 10. While circuit 10 will be discussed herein as applied to a gas range cook top burner 12 for purposes of illustration, one of skill in the art will readily recognize that the circuit of the present invention is equally well suited for many other applications such as clothes dryers, water heaters or industrial gas burner applications.

The burner 12 is provided with a supply of combustible gas (not shown) which is ignited by a series of sparks 14 selectively emitted by a spark electrode 16 upon receipt of a high voltage pulse from a transformer 18 to produce a flame 20. Transformer 18 is electrically coupled in series with a discharge capacitor C2. A silicon controlled rectifier (SCR) Q6 is wired in parallel. SCR Q6 has its gate coupled to a diac 22, which is also coupled to a node between series connected capacitor C3 and resistor R1. The same node is also coupled to the collector of a transistor Q5 having its emitter and collector connected across capacitor C3. The gate of transistor Q5 is coupled to a capacitor C5 and to ground through a zener diode D1.

Zener D1 is also connected through resistor R2 to a diode D2 which is connected, both through series connected capacitor C1 and resistor R3, to an incoming line voltage 22 of a single phase alternating current source (not shown), and through a diode D3 to the neutral line 24 of the same source. Diode D3 is likewise grounded and connected to ac source ground line 26 through a resistor R4.

At least one flame sensing electrode 28 is disposed with respect to burner 12 so as to contact a flame 20 produced thereby. Flame sensing electrode 28 is preferably placed peripherally about burner 12 so as to be in a position least susceptible to flame waver. Electrode 28 is also preferably positioned close enough to burner 12 so as to be able to contact, and thereby detect, a flame at the lowest expected level. One or more additional flame electrodes 30 may also be disposed about burner 12 so as to increase system accuracy by sensing the presence of a flame that may have wavered momentarily out of reach of flame electrode 28.

Electrode 28 is coupled through a resistor R20 to the base of a transistor Q1. The same base is also connected to supply line 22 through series connected resistor R5, capacitor C4, and burner switch S1, and is grounded through both resistor R6 and capacitor C6. Resistor R6 and capacitor C6 are tied in parallel between the gate and emitter of transistor Q1, the emitter being grounded. The collector of Q1 is also coupled to line 34 which is connected to spark control circuits of other burners.

In the initial absence of a flame and upon the application of electrical power to the circuit by a suitable on/off switching circuit actuable by a user (not shown), Q1 is turned on and Q5 is turned off. Once C3 charges to a predefined level, SCR Q6 is fired, discharging C2, and transformer 18 facilitates the production of sparks 14 through electrode 16. Once burner 12 is lit and in the continued presence of a flame, transistor Q1 is off since the flame acts as a rectifier in series with a resistor and thereby causes a shunt to ground. When Q1 is off, transistor Q5 is on, thereby preventing capacitor C3 from being able to charge to a level sufficient to fire SCR Q6, in the presently preferred embodiment of the invention, to about 35 volts. When Q5 is on, there is no current flowing through transformer 18 and the production of sparks is inhibited.

When a flame is no longer sensed by an electrode 28, Q1 turns on, thereby dropping the voltage at the base of transistor Q5 to turn Q5 off and make it non-conducting. When this occurs, capacitor C3 charges to a level sufficient to cause diac 22 to fire SCR Q6. This energizes transformer 18 so as to generate high powered pulses to create ignition sparks, the timing of which are controlled through an RC time constant set via the selection of R1 and C3, and the breakover voltage of diac 22 to a lesser degree.

Thus, transistor Q5 inhibits the production of sparks as long as Q1 is off. When Q1 is switched on, the production of sparks is enabled since capacitor C3 is allowed to charge. Optional placement of flame sensing electrode 28, and optionally electrode 30, provides more accuracy in the circuit and prevents unnecessary sparking. Since electrode 30 is tied to electrode 28 in parallel, transistor Q1 is only switched on only in the absence of a flame at both electrodes 28 and 30. In cases of momentary flame waver when, for instance, electrode 28 senses a flame but electrode 30 does not, transistor Q1 remains off and sparking is inhibited.

Figure 2:
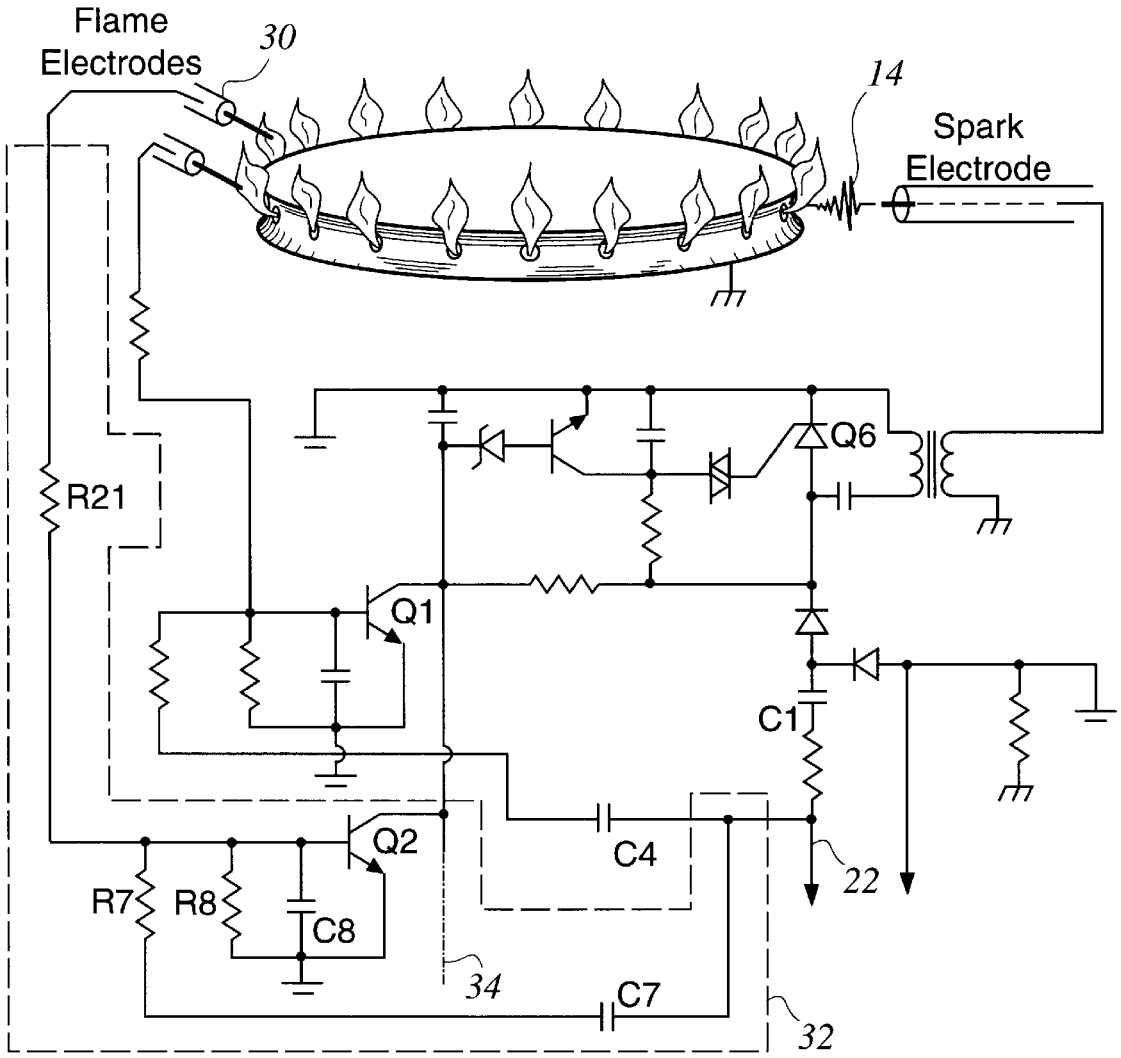
FIG. 2 is a schematic diagram similar to FIG. 1 of an alternate embodiment of the present invention which employs redundant flame sensing circuits.

In an alternate embodiment of the present invention, as depicted in FIG. 2, the additional flame electrode 30 includes a redundant flame sensing circuit 32. Circuit 32 interfaces with circuit 10, illustrated in FIG. 1, but includes additional redundant elements. Electrode 30 is coupled through a resistor R21 to the gate of a redundant transistor Q2. The Q2 gate is grounded through resistor R8 in parallel with a capacitor C8 and is coupled through series connected resistor R7 and capacitor C7 to supply line 22. The emitter of transistor Q2 is tied to ground as well as R8 and C8 and the collector is tied to the collector of transistor Q1.

This alternate configuration allows the use of multiple flame electrodes connected to multiple logic transistor inputs and thereby provides redundancy in the flame sensing circuitry to better compensate for any wavering of the flame. While this approach may add some incremental cost, the associated expense may be negligible when burner control is consolidated with oven control. In addition, redundancy in appliance control is often desired in an effort to substantially reduce or eliminate the need for repairs since the cost of a redundant circuit element is very small when compared with the price of a service call. Moreover, as microprocessor control of gas range systems becomes more popular in reducing operator attended functions, circuit redundancy provides one possible approach toward fail-safe operation required by regulating agencies and government standards.

The foregoing discloses and describes merely an exemplary embodiment of the present invention. One having skill in the art will readily recognize that various changes and modifications can be made thereto without departure from the spirit and scope of the present invention as set forth in the following claims. As an example, the multiple electrodes 28 and 30 may also be fabricated using a different geometry to more closely follow the periphery of the flame circumferentially about the burner rather than in a point-sensing manner as FIG. 1 shows.

What is claimed is:

1. A circuit for monitoring the presence of a flame produced by a gas burner and for reigniting the burner in the event of flame failure, said circuit comprising:

a source of electrical current;

a flame sensor for monitoring a flame produced at said burner and for outputting an electrical signal indicative of the sensed Presence or absence of said flame, wherein said flame sensor includes at least two electrodes disposed in a spaced relationship about the periphery of said burner and positioned so as to contact a flame produced thereby;

a switch circuit for receiving said sensor output signal and, in response to a sensor output signal indicative of the sensed absence of a flame, outputting a triggering signal of limited duration;

a spark generator circuit for producing a series of sparks to reignite said burner; and a disabling circuit for disabling said spark generator in response to the termination of receipt of a triggering signal from said switch circuit.

2. The circuit of claim 1 wherein said switch circuit outputs a triggering signal indicative of a sensed flame absence only when in receipt of a flame sensor output signal from each said flame sensor indicative of a sensed flame absence.

3. The circuit of claim 1 further comprising an additional switch circuit for each additional flame sensing electrode.

4. The circuit of claim 3 wherein said disabling circuit is adapted to disable said spark generator in the absence of receipt of triggering signals from each said switch circuit.

5. The circuit of claim 1 wherein said two electrodes are contained in a single assembly.

6. A circuit for monitoring the presence of a flame produced by a gas burner and for reigniting the burner in the event of flame failure, said circuit comprising:

a source of electrical current;

a flame sensor for monitoring a flame produced at said burner and for outputting an electrical signal indicative of the sensed presence or absence of said flame; wherein said flame sensor includes at least two electrodes disposed in a spaced relationship about the periphery of said burner and positioned so as to contact a flame produced thereby, a switch circuit for receiving said sensor output signal and, in response to a sensor output signal indicative of the sensed absence of a flame, outputting a triggering signal;

a spark generator circuit for producing a series of sparks to reignite said burner; and a disabling circuit for disabling said spark generator in response to the absence of receipt of a triggering signal from said switch circuit, and an additional switch circuit for each additional flame sensing electrode.

7. The circuit of claim 6 wherein said disabling circuit is adapted to disable said spark generator in the absence of receipt of triggering signals from each said switch circuit.

8. A circuit for monitoring the presence of a flame produced by a gas burner and for reigniting the burner in the event of flame failure, said circuit comprising:

a source of electrical current;

a flame sensor for monitoring a flame produced at said burner and for outputting an electrical signal indicative of the sensed presence or absence of said flame;

a switch circuit for receiving said sensor output signal and, in response to a sensor output signal indicative of the sensed absence of a flame, outputting a triggering signal;

a spark generator circuit for producing a series of sparks to reignite said burner; and a disabling circuit for disabling said spark generator in response to the absence of receipt of a triggering signal from said switch circuit; and wherein the switch circuit enables the spark generator circuit in the presence of a triggering signal and enables the disabling circuit upon termination of the triggering signal; and wherein said flame sensor includes at least two electrodes disposed in a spaced relationship about the periphery of said burner and positioned so as to contact a flame produced thereby.

9. The circuit of claim 8 wherein said switch circuit outputs a triggering signal indicative of a sensed flame absence only when in receipt of a flame sensor output signal from each said flame sensor indicative of a sensed flame absence.

10. The circuit of claim 8 further comprising an additional switch circuit for each additional flame sensing electrode.

11. The circuit of claim 10 wherein said disabling circuit is adapted to disable said spark generator in the absence of receipt of triggering signals from each said switch circuit.

12. The circuit of claim 8 wherein said two electrodes are contained in a single assembly.

13. The circuit of claim 1 wherein said spaced relationship is selected to minimize an occurrence of nuisance spark generation due to flame waiver.

14. The circuit of claim 1 wherein said at least two electrodes are tied in parallel such that said flame sensor outputs said electrical signal upon the sensed absence of a flame by both of said at least two electrodes.

15. The circuit of claim 1 wherein said spaced relationship is selected to allow sensing of the presence of a flame by one of said electrodes that may have waived momentarily out of reach of another of said electrodes, thereby increasing in system accuracy.

16. The circuit of claim 6 wherein said spaced relationship is selected to minimize an occurrence of nuisance spark generation due to flame waiver.

17. The circuit of claim 6 wherein said at least two electrodes are tied in parallel such that said flame sensor outputs said electrical signal upon the sensed absence of a flame by both of said at least two electrodes.

18. The circuit of claim 6 wherein said spaced relationship is selected to allow sensing of the presence of a flame by one of said electrodes that may have waived momentarily out of reach of another of said electrodes thereby increasing in system accuracy.

19. The circuit of claim 8 wherein said spaced relationship is selected to minimize an occurrence of nuisance spark generation due to flame waiver.

20. The circuit of claim 8 wherein said at least two electrodes are tied in parallel such that said flame sensor outputs said electrical signal upon the sensed absence of a flame by both of said at least two electrodes.

21. The circuit of claim 8 wherein said spaced relationship is selected to allow sensing of the presence of a flame by one of said electrodes that may have waived momentarily out of reach of another of said electrodes thereby increasing in system accuracy.

* * * * *